US010980683B2

(12) United States Patent
Borges Belza

(10) Patent No.: US 10,980,683 B2
(45) Date of Patent: Apr. 20, 2021

(54) STRETCHER FOR PEOPLE WITH REDUCED MOBILITY

(71) Applicant: Manuel Jacinto Borges Belza, Santa Cruz de Tenerife (ES)

(72) Inventor: Manuel Jacinto Borges Belza, Santa Cruz de Tenerife (ES)

( * ) Notice: Subject to any disclaimer, the term of this patent is extended or adjusted under 35 U.S.C. 154(b) by 151 days.

(21) Appl. No.: 16/315,055

(22) PCT Filed: Jul. 7, 2016

(86) PCT No.: PCT/ES2016/070512
§ 371 (c)(1),
(2) Date: Jan. 3, 2019

(87) PCT Pub. No.: WO2018/007655
PCT Pub. Date: Jan. 11, 2018

(65) Prior Publication Data

US 2019/0307618 A1 Oct. 10, 2019

(51) Int. Cl.
*A61G 1/003* (2006.01)
*A61G 1/017* (2006.01)
(Continued)

(52) U.S. Cl.
CPC ..... *A61G 1/003* (2013.01); *A61G 1/017* (2013.01); *A61G 1/02* (2013.01); *A61G 7/0005* (2013.01);
(Continued)

(58) Field of Classification Search
CPC .... A61G 1/003; A61G 7/1076; A61G 7/1036; A61G 7/1046; A61G 7/1057;
(Continued)

(56) References Cited

U.S. PATENT DOCUMENTS 2,404,734 A * 7/1946 Lenahan ..... A61G 7/1019 5/86.1
3,752,261 A * 8/1973 Bushnell, Jr. ..... E04G 1/22 182/17
(Continued)

FOREIGN PATENT DOCUMENTS

CH 669907 A5 * 4/1989 ..... A61G 7/1046
CH 669907 A5 4/1989
(Continued)

*Primary Examiner* — Peter M. Cuomo
*Assistant Examiner* — Myles A Throop
(74) *Attorney, Agent, or Firm* — Hayes Soloway PC

(57) ABSTRACT

An autonomous stretcher intended for patients with reduced mobility, particularly quadriplegic and paraplegic, is adjustable in height and transformable between a horizontal position in the manner of a bed for housing the patient lying down and a staggered position in the manner of a chair. It incorporates transport litters destined for supporting the patient, endowed with movement in a transverse direction to the supports in both directions of movement: towards the exterior of the stretcher to remove the patient from the stretcher, for example towards a bed or a wheelchair and towards the interior of the stretcher to accommodate the patient therein. It makes it possible to modify its longitudinal or transverse orientation with respect to the frame and enables the patient to satisfy his or her physiological evacuation needs through the stretcher itself in a sitting position.

19 Claims, 14 Drawing Sheets

(51) Int. Cl.

| | |
|---|---|
| ***A61G 1/02*** | (2006.01) |
| ***A61G 7/10*** | (2006.01) |
| ***A61G 7/02*** | (2006.01) |
| ***A61G 7/00*** | (2006.01) |
| ***A61G 5/10*** | (2006.01) |

(52) U.S. Cl.
CPC ..... *A61G 7/02* (2013.01); *A61G 7/1019* (2013.01); *A61G 7/1032* (2013.01); *A61G 7/1036* (2013.01); *A61G 7/1046* (2013.01); *A61G 7/1057* (2013.01); *A61G 7/1076* (2013.01); *A61G 5/1059* (2013.01); *A61G 2200/32* (2013.01); *A61G 2200/34* (2013.01)

(58) Field of Classification Search
CPC ..... A61G 7/1019; A61G 7/02; A61G 7/1032; A61G 7/0005; A61G 1/017; A61G 1/02; A61G 2200/32; A61G 2200/34; A61G 5/1059; A61G 7/10; A61G 7/14
USPC ..... 5/87.1, 626
See application file for complete search history.

(56) References Cited

U.S. PATENT DOCUMENTS

| | | | | | |
|---|---|---|---|---|---|
| 3,967,328 | A * | 7/1976 | Cox | A61G 1/003 | 5/81.1 C |
| 4,700,415 | A * | 10/1987 | DiMatteo | A61G 5/006 | 297/DIG. 4 |
| 5,022,810 | A * | 6/1991 | Sherrow | A61G 7/1019 | 212/303 |
| 5,193,633 | A * | 3/1993 | Ezenwa | A61G 5/006 | 180/271 |
| 5,201,377 | A * | 4/1993 | Wilson | A61G 5/045 | 180/6.5 |
| 5,285,539 | A * | 2/1994 | Anderson | A47K 3/125 | 4/564.1 |
| 5,379,468 | A * | 1/1995 | Cassidy | A61G 5/045 | 280/304.1 |
| 6,378,148 | B1 | 4/2002 | Votel | | |
| 7,487,559 | B1 * | 2/2009 | Denosky | A61G 7/1025 | 5/81.1 HS |
| 9,021,633 | B2 * | 5/2015 | Chun | A61G 7/1076 | 5/611 |
| 9,084,707 | B2 * | 7/2015 | Patterson | A61G 7/1046 | |
| 10,624,805 | B2 * | 4/2020 | Mahjoubi | A61G 7/1057 | |
| 2004/0168252 | A1 | 9/2004 | Yoshimori | | |
| 2005/0066442 | A1 | 3/2005 | Kasagami et al. | | |
| 2006/0258964 | A1 * | 11/2006 | Biondo | A61H 9/0078 | 601/152 |
| 2009/0158523 | A1 * | 6/2009 | Burak, Jr. | A61G 7/1057 | 5/87.1 |
| 2010/0064431 | A1 * | 3/2010 | Kawakami | A61G 7/1046 | 5/81.1 RP |
| 2011/0016627 | A1 * | 1/2011 | Blevins | A61G 7/1019 | 5/83.1 |
| 2011/0238217 | A1 * | 9/2011 | Kume | A61G 7/1032 | 700/275 |
| 2013/0007957 | A1 * | 1/2013 | Chun | A61G 7/1046 | 5/87.1 |
| 2016/0310338 | A1 * | 10/2016 | Wunderlich | A61G 7/1048 | |
| 2017/0020759 | A1 * | 1/2017 | Gon Alo De Freitas | A61G 7/1032 | |
| 2017/0112692 | A1 * | 4/2017 | Arimura | A61G 1/0212 | |

FOREIGN PATENT DOCUMENTS

| | | | | |
|---|---|---|---|---|
| EP | 2428197 | A1 * | 3/2012 | A61G 7/1036 |
| EP | 2428197 | A1 | 3/2012 | |
| EP | 2965738 | A1 | 1/2013 | |
| WO | 8701583 | | 3/1987 | |
| WO | 9109585 | | 7/1991 | |
| WO | 2011067594 | A1 | 6/2011 | |

* cited by examiner

STRETCHER FOR PEOPLE WITH REDUCED MOBILITY

CROSS-REFERENCE TO RELATED APPLICATIONS AND PRIORITY

This patent application claims priority from International Patent Application No. PCT/ES2016/070512 filed Jul. 7, 2016, which is herein incorporated by reference in its entirety.

OBJECT OF THE INVENTION

The present invention relates to a stretcher intended for patients with total immobility (quadriplegic) or partial immobility (paraplegic), for patients affected by Alzheimer's Disease, for post-surgery transfers from the operating room or operating table to a normal stretcher or directly to the bed or, in general, it can be said that the stretcher is of use for people with reduced mobility.

BACKGROUND OF THE INVENTION

Some articulated stretchers are known which can adopt a horizontal configuration in the manner of a bed or a staggered configuration in the manner of a chair, which incorporate arms that form three bodies that constitute the backrest, seat and leg rest which, on the one hand, can move in height due to the action of hydraulic cylinders and, on the other, the backrest or leg rest can swing with respect to the seat, likewise by means of hydraulic mechanisms, to pass from the horizontal position to the staggered position and vice versa.

This type of stretchers allow a disabled patient to control the operation of the stretcher to adopt the desired position; however, when the patient must be transferred from the stretcher to a bed or to a wheelchair the help of a nurse will be required, since this type of stretchers lack means that facilitate this transfer.

This situation is more critical if the patient must be transferred from the operating table to a stretcher after an operation or directly to the bed, since the patient is drowsy from the anaesthesia and does not cooperate with this action. The nurse transfers the patient using his or her arms but, since there is no homogeneous understanding on sustaining, stretching or depositing the patient, and the patient's incision from the operation is not normally visible due to being covered by gauze or bandages, the nurse may involuntarily cause one or two of the patient's stitches to burst.

Furthermore and in general, one of the main concerns in disabled people is the need for specialised nurses to help them with all their physiological needs for evacuating physiological waste, in addition to grooming, cleaning, showering and even when the patient wishes to move to another place without moving from the bed, such as for example near a window for his or her visual entertainment and distraction. In these cases they also require the help of a nurse.

DESCRIPTION OF THE INVENTION

The present invention relates to a stretcher for people with reduced mobility that provides a satisfactory solution to the previously expounded problems, being endowed with several degrees of freedom that facilitate a multitude of operations, particularly transferring the patient from the stretcher to a wheelchair or to a bed automatically, distributing his or her weight and with barely any movement, without need for the nurses to intervene and, inter alia, allowing the patient to satisfy his or her physiological evacuation needs directly through the stretcher itself.

The stretcher basically comprises a base or frame, a column that is extended or retracted in height with respect to the frame, which has an upper end and a lower end, a fixed central support mounted on the upper end of the column, a front support tilting with respect to a fixed central support and a rear support tilting with respect to the central support. Likewise, it has front, central and rear modules that can be coupled to the front, central and rear supports, respectively, wherein the modules are constituted in the patient's leaning sectors in his or her lying or sitting position.

Based on this configuration, the stretcher object of this invention stands out basically because the modules are endowed with transport litters capable of moving in a direction transversal to the supports actuated by a drive motor. The litters are endowed with movement in a direction transversal to the support, in both directions of movement: towards the exterior of the stretcher for removing the patient from the stretcher and towards the interior of the stretcher to accommodate the patient therein.

In order to facilitate the transfer of the patient from the bed to the stretcher, the optional possibility has been envisaged that the stretcher may incorporate holding and dragging mechanisms which are mounted on the supports and each of which has a scoop in contact with the patient, holding him or her in an initial phase and subsequently dragging him or her in a final phase in the same direction of movement of the litters.

In order to cooperate with the action of transferring the patient to or from the stretcher, it has also been envisaged that the column that supports the modules will also have a tilting movement with respect to the frame and a transversal displacement movement with respect to the frame itself. In this regard, it has been envisaged that the column will be mounted with the possibility of tilting with respect to a carriage, which in turn is displaceable transversely with respect to the frame, wherein the frame preferably has a central cavity whereon the carriage moves.

Furthermore, as mentioned earlier, the stretcher can be used to facilitate the patient's physiological action of evacuation in a sitting position, in which case the central module comprises two smaller transport stretchers instead of one, disposed distant to each other, where between a space destined for allowing the patient to evacuate therethrough is defined, for example a portable toilet that can be disposed underneath in correspondence with said space.

It has also been envisaged that these small litters will be solidarily actuated by a motor and a shaft that links the movement of both litters. In this manner, the patient may be transferred from the stretcher in a sitting position to a wheelchair disposed adjacent to the stretcher or the opposite, from the wheelchair to the stretcher, activating the movement of the small litters of the central module and the litters of the front module and rear module.

Furthermore, the stretcher also envisages the possibility of moving the front and rear modules with respect to the central module to adapt its position to the patient's size, wherein each front and rear support incorporates respective arms for such purpose: a fixed arm and an extendable arm with respect to the fixed arm, wherein each module is linked to the extendable arm, such that it can be actuated over the position of each extendable arm to position the front and rear module with respect to the central module in accordance with the height of each patient.

The stretcher object of this invention can also be rotated by turning the front, central and rear modules jointly with respect to the frame, in order to pass from a longitudinal position of the modules to a transverse position, having blocking means that fix said positions. In this manner the patient can change his or her orientation, for example, to sit near a table or to look out of a window.

Additionally, it should be noted that the stretcher can be used as the patient's place of personal grooming, to which end it may incorporate a bathing enclosure, preferably made of flexible plastic, equipped with a drain, which can preferably be coupled to the modules.

Correspondingly, it has been envisaged that the frame will incorporate a clean water tank and a dirty water tank wherefrom respective ducts emerge, a clean water duct that leads to the bathing enclosure and a dirty water duct connected to the drain of the bathing enclosure.

Likewise, the stretcher may incorporate a curtain that may be coupled to the modules, for example, to protect the patient's privacy while bathing or while satisfying his or her physiological evacuation needs.

The stretcher is preferably autonomous and incorporates a set of batteries integrated in the frame that feeds the motors and other hydraulic elements, and has connections for connecting ancillary equipment, such as a dryer, for example, which can be used to dry the patient after bathing.

In short, it is a stretcher that facilitates the autonomy of physically disabled people, since it allows them to move and adopt different positions outside of the bed in which they are normally confined in a simple and automated manner, by simply actuating a single command or control element that commands the different motors and hydraulic elements to regulate all the stretcher positions.

Likewise, this stretcher grants the patient independence when satisfying his or her physiological evacuation needs, without need for the presence and help of other people. This last aspect is of great importance to the patient, like the possibility it offers of being able to groom him or herself in the stretcher itself.

Furthermore, it should be noted that the stretcher has been dimensioned for its use in hospitals, clinics or outpatients clinics and particularly in private homes, due to which it has the appropriate means for crossing doorways 75 cm wide.

DESCRIPTION OF THE DRAWINGS

In order to complement the description being made and with the object of helping to better understand the characteristics of the invention, in accordance with a preferred embodiment thereof, this specification is accompanied as an integral part of said description by a set of drawings where, in an illustrative and non-limiting manner, the following has been represented.

PREFERRED EMBODIMENT OF THE INVENTION

In light of the figures, following is a preferred embodiment of the stretcher for people with reduced mobility that constitutes the object of this invention.

Figure 1:
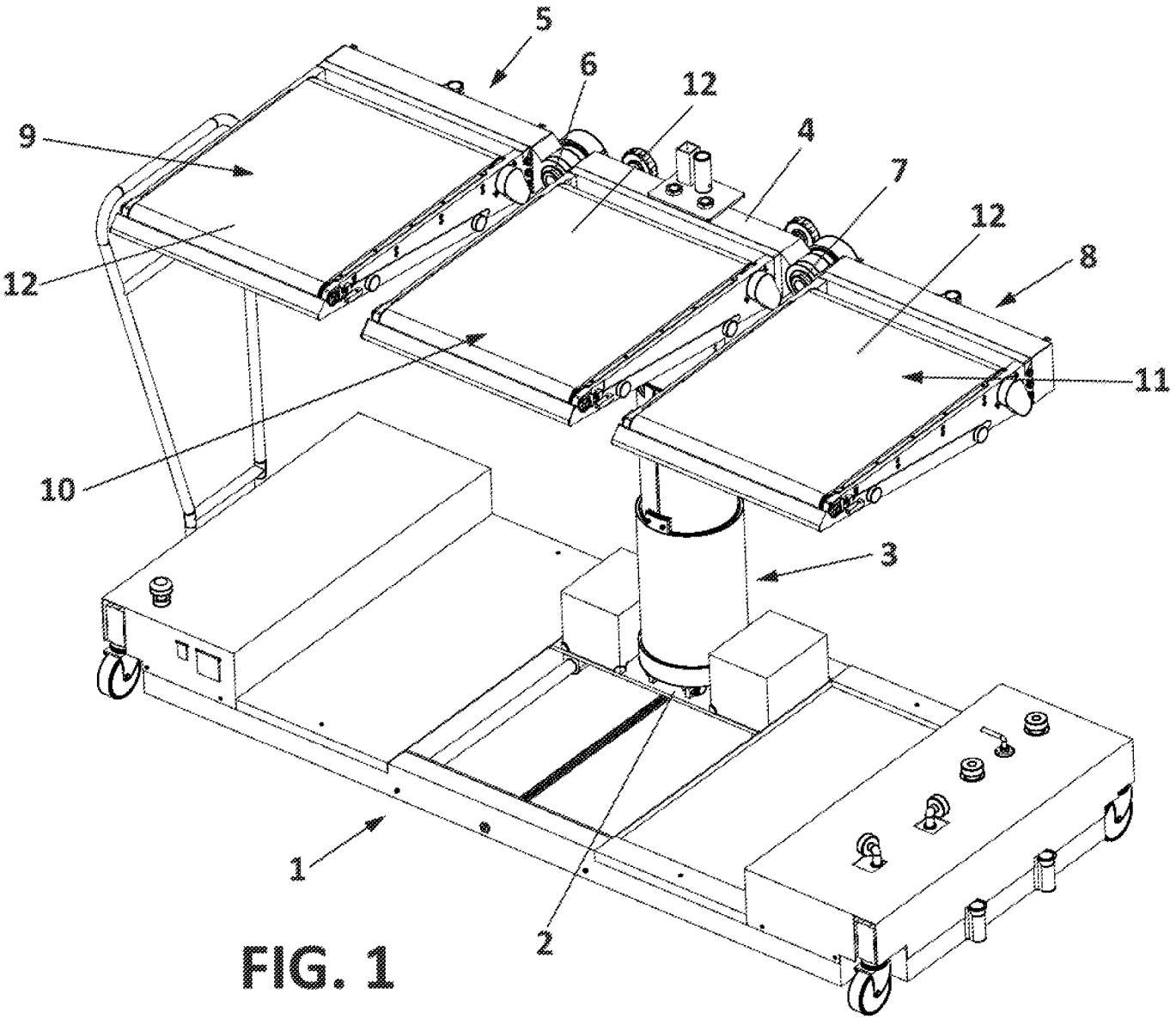
FIG. 1 shows a perspective view of the stretcher in an extended horizontal position with a longitudinal orientation.

As can be observed in FIG. 1, the stretcher basically comprises a base or frame (1) having a wide central cavity, a carriage (2) movable in a transverse direction inside said cavity, a column (3) that is extended or retracted in height having an upper end and a lower end, wherein the lower end is assembled such as to allow tilting with respect to the carriage (2), a central fixed support (4) mounted on the upper end of the column (3), which has a front end (6) and a rear end (7).

Likewise, the stretcher comprises a front support (5) tilting with respect to the front end (6) of the fixed central support (4), a rear support (8) tilting with respect to the rear end (7) of the central fixed support (4), front (9), central (10) and rear (11) modules that can be coupled to the front (5), central (4) and rear (8) supports, respectively, having transport litters (12) destined for moving the patient from the stretcher, for example to a bed or from the bed to the stretcher, actuated by drive motors.

The modules (9, 10, 11) can be disposed in a coplanar layout in the manner of a bed to facilitate the position of the patient lying down, as observed in FIG. 1, who would lean his or her lower limbs, torso and head respectively on the front (9), central (10) and rear (11) modules.

Figure 2:
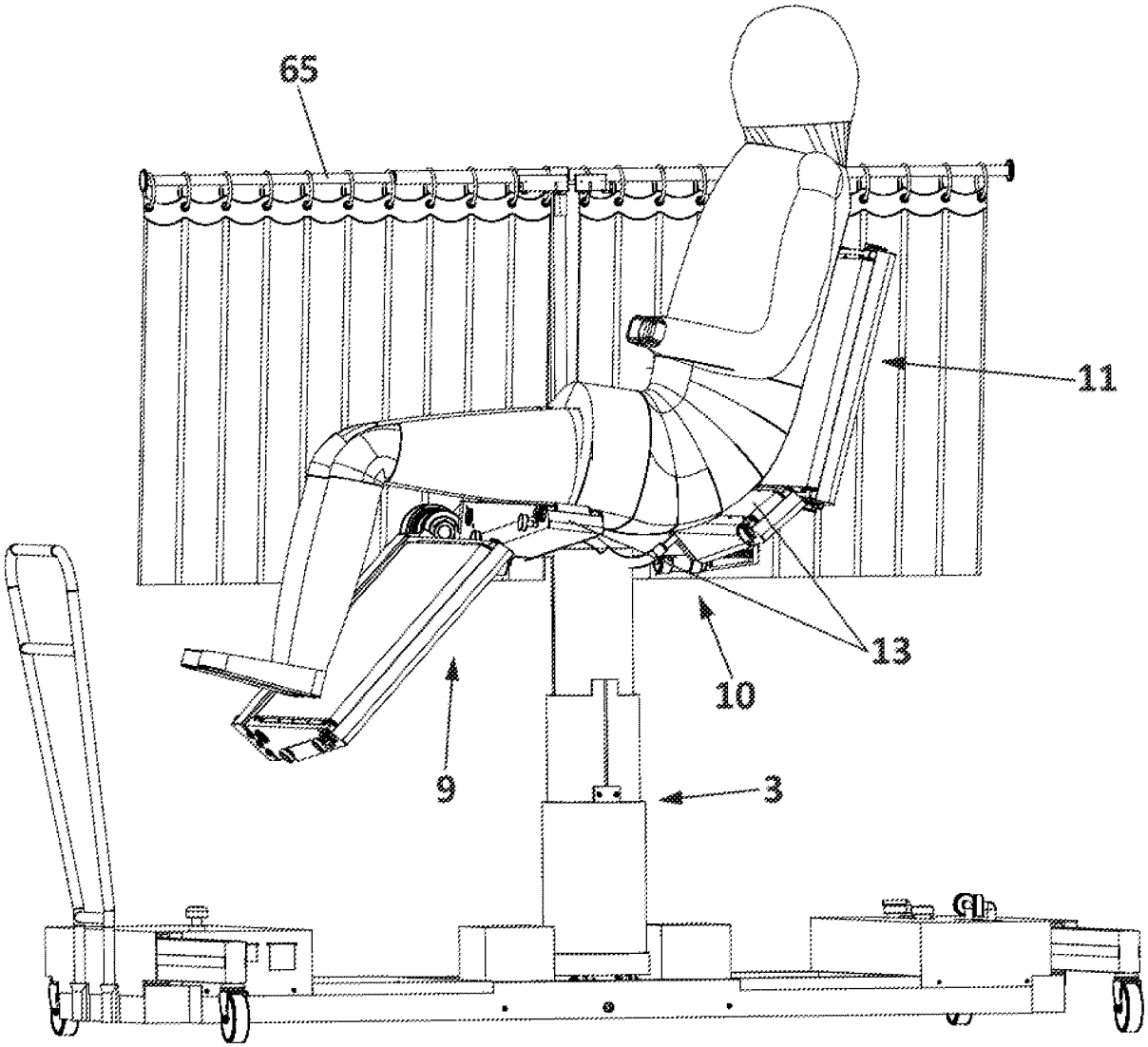
FIG. 2 shows a side view of the stretcher adopting the position of a chair with a patient positioned thereon, for example to satisfy his or her physiological evacuation needs.

Another possibility envisaged in the stretcher is that the modules (9, 10, 11) will be disposed staggered with respect to the front module (9) and the rear module (11) tilted with respect to the central module (10), adopting a configuration in the manner of a chair or armchair to facilitate the patient's sitting position, as can be observed in FIG. 2, with the front module (9) acting as a leg rest and the rear module (11) acting as a backrest.

Figure 3:
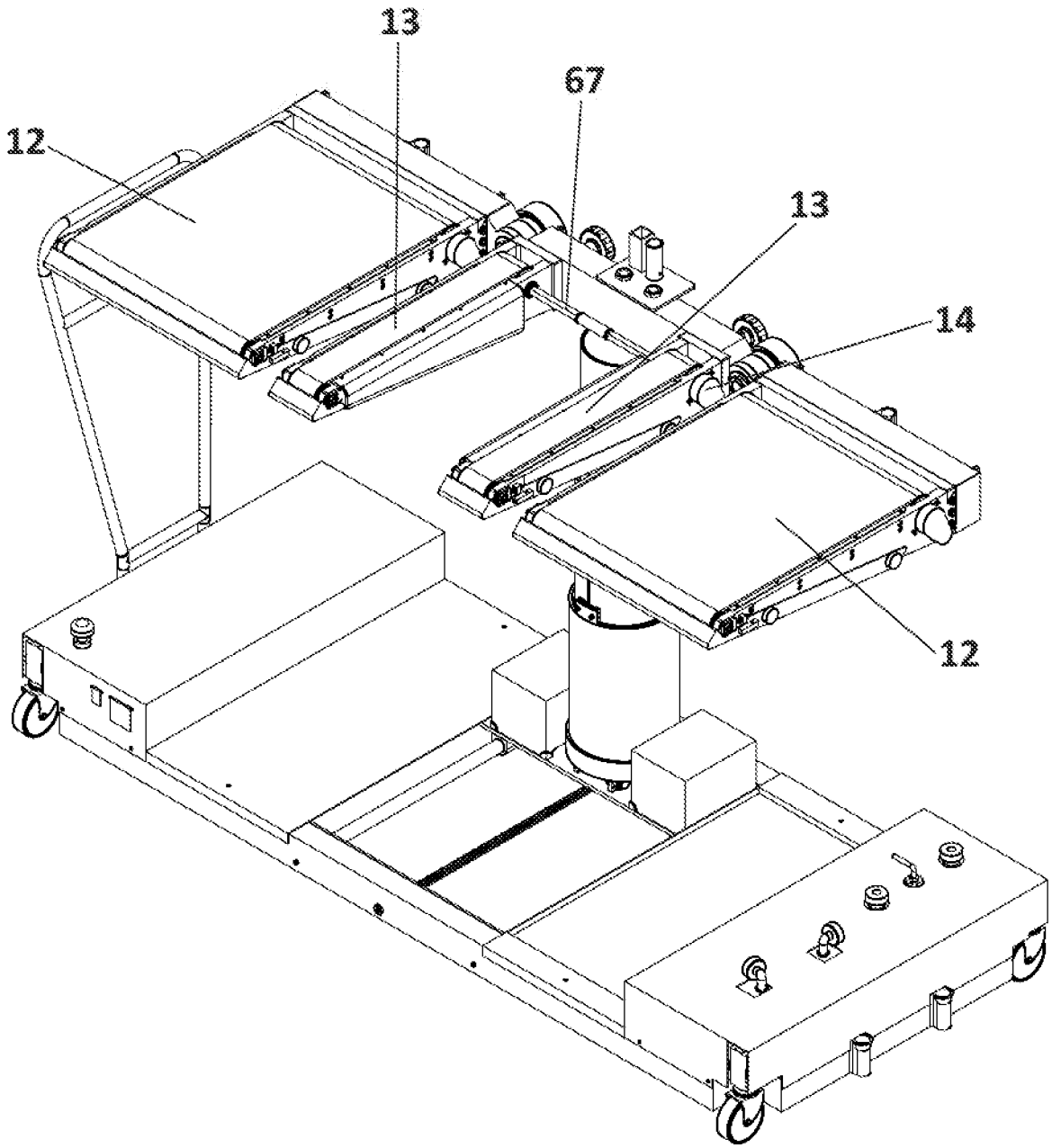
FIG. 3 shows a perspective view of the stretcher in a horizontal position with longitudinal orientation for those cases where the central module of FIG. 2 is used, which facilitates the patient's physiological action of evacuation.

The stretcher can be used to facilitate the physiological action of the patient therethrough in this sitting position, as represented in said FIG. 2, to which end it has been envisaged that the central module (10) that can be coupled to the central support (4) will comprise two smaller transport litters (13) instead of one, distant from each other, where between a space is defined to allow the physiological evacuation of the patient, as can be more clearly observed in FIG. 3.

These smaller litters (13) are solidarily actuated by a drive motor (14) and a shaft (67) that links the movement of the two smaller litters (13).

Figure 4:
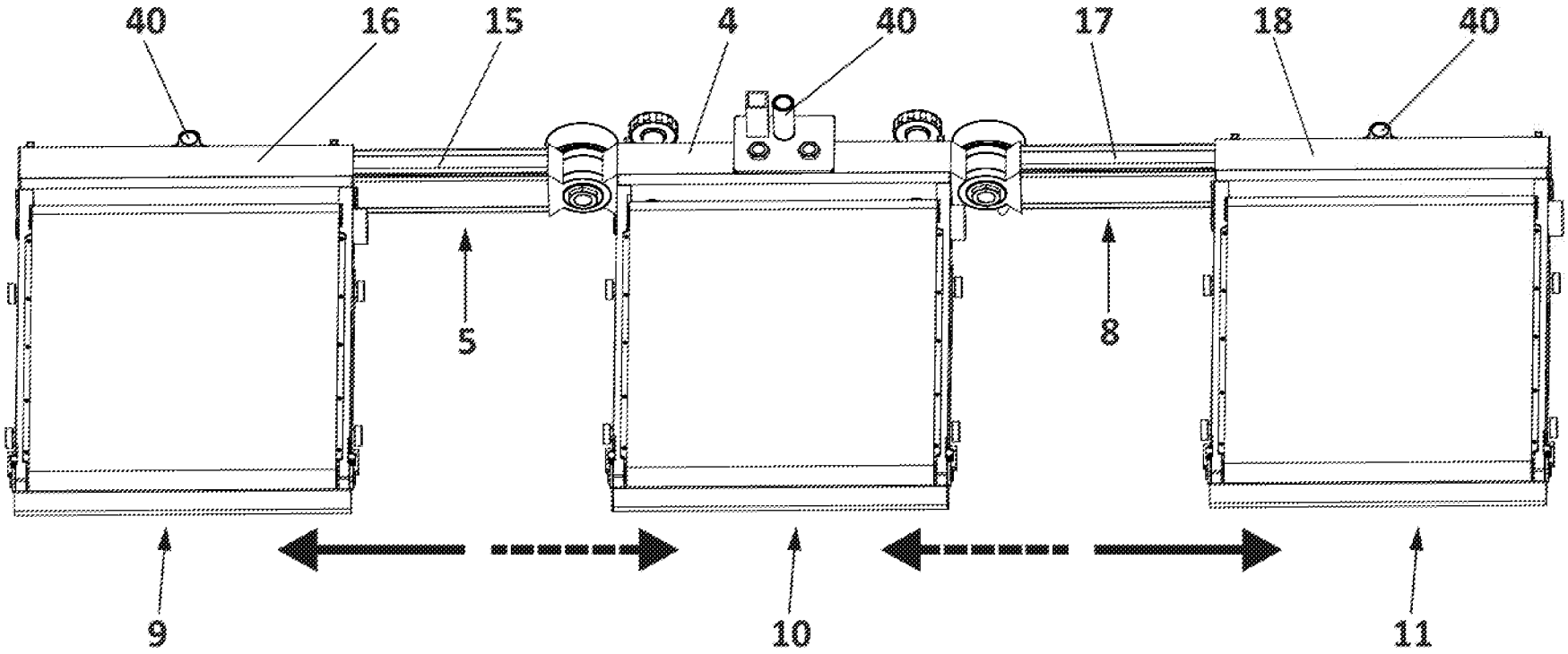
FIG. 4 shows a plan view wherein the possibility of adapting the front and rear modules at a distance from the central module can be observed.

FIG. 4 shows that the front support (5) is formed by an inner front arm (15) and an extendable front arm (16) which is longitudinally movable with respect to the inner front arm (15). Furthermore, the front module (9) is in turn mounted on the extendable front arm (16).

Likewise, the rear support (8) is formed by an inner rear arm (17) and an extendable rear arm (18) which is longitudinally movable with respect to the inner rear arm (17). Furthermore, the rear module (11) is mounted, in turn, on the extendable rear arm (18).

By virtue of the foregoing, the movement of the extendable front arm (16) determines the solidary movement of the front module (9) with respect to the central module (10), in the same manner as the movement of the extendable rear arm (18) determines the solidary movement of the rear module (11) with respect to the central module (10), which makes it possible to adapt the position of the modules (9, 11) to the size of the patient, as can be observed in FIG. 4.

Figure 5:
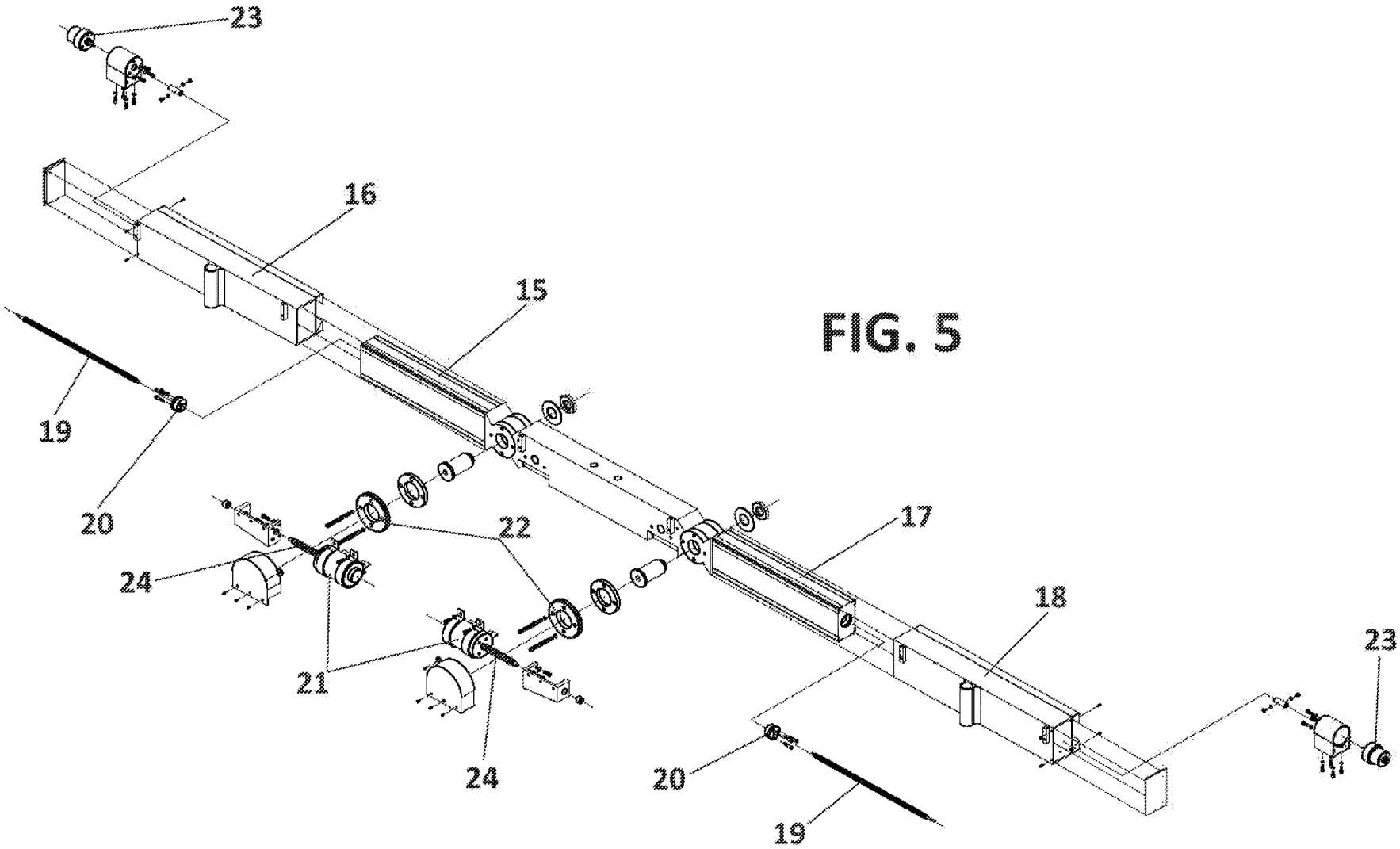
FIG. 5 shows an exploded view of the front, central and rear supports.

FIG. 5 shows how, preferably, the movement of the extendable arms (16, 18) with respect to the inner arms (15, 17) is performed by means of rotary switches (23) mounted on the ends of the extendable arms (16, 18). These rotary switches (23) cause the rotation of worm screws (19) that are threaded onto bushings (20) solidly connected to the inner arms (15, 17), such that they transform the rotary movement of the rotary switches (20) into a longitudinal movement of the extendable arms (16, 18).

Figure 6:
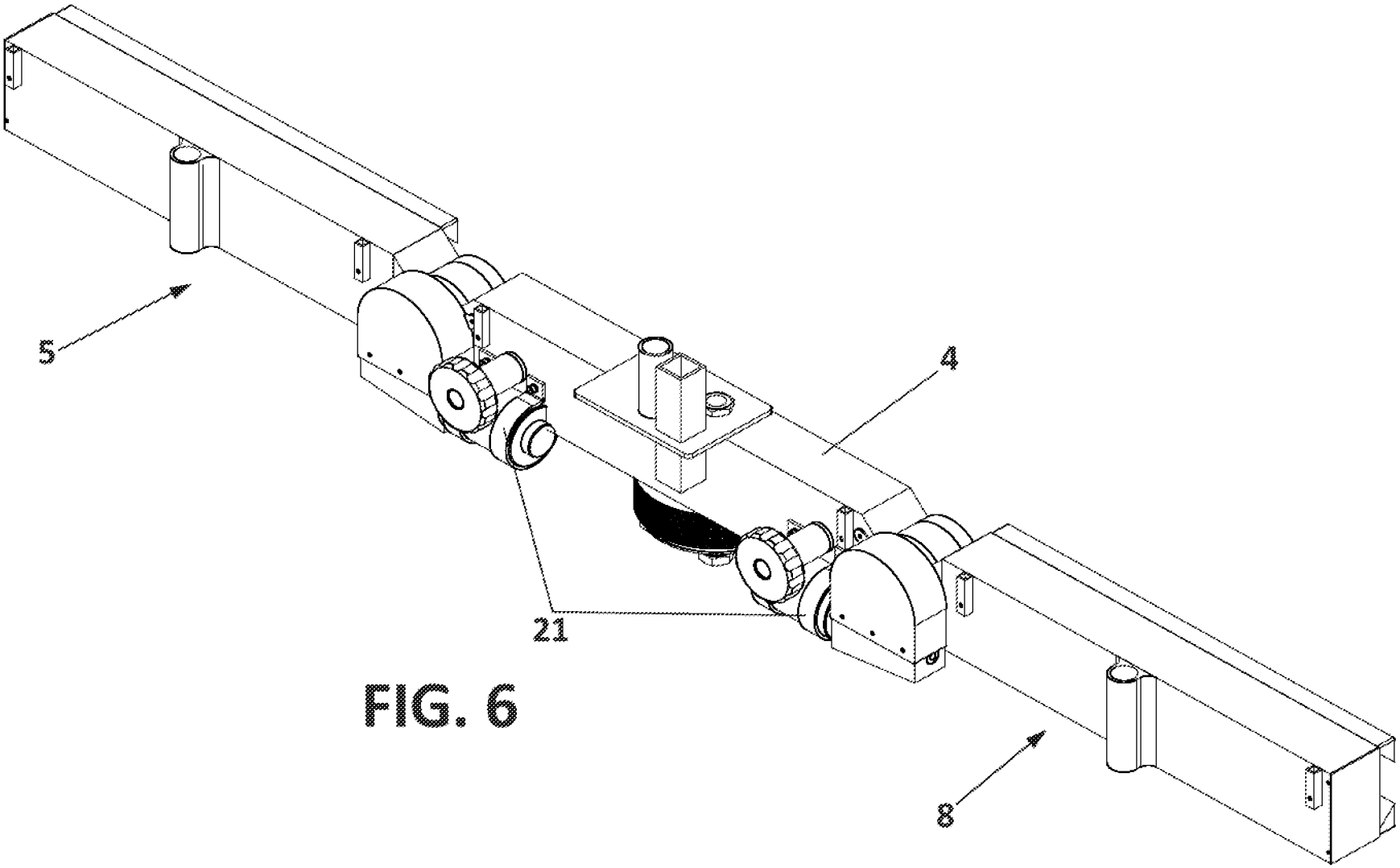
FIG. 6 shows a perspective view of the assembly of the front, central and rear supports.
Figure 7:
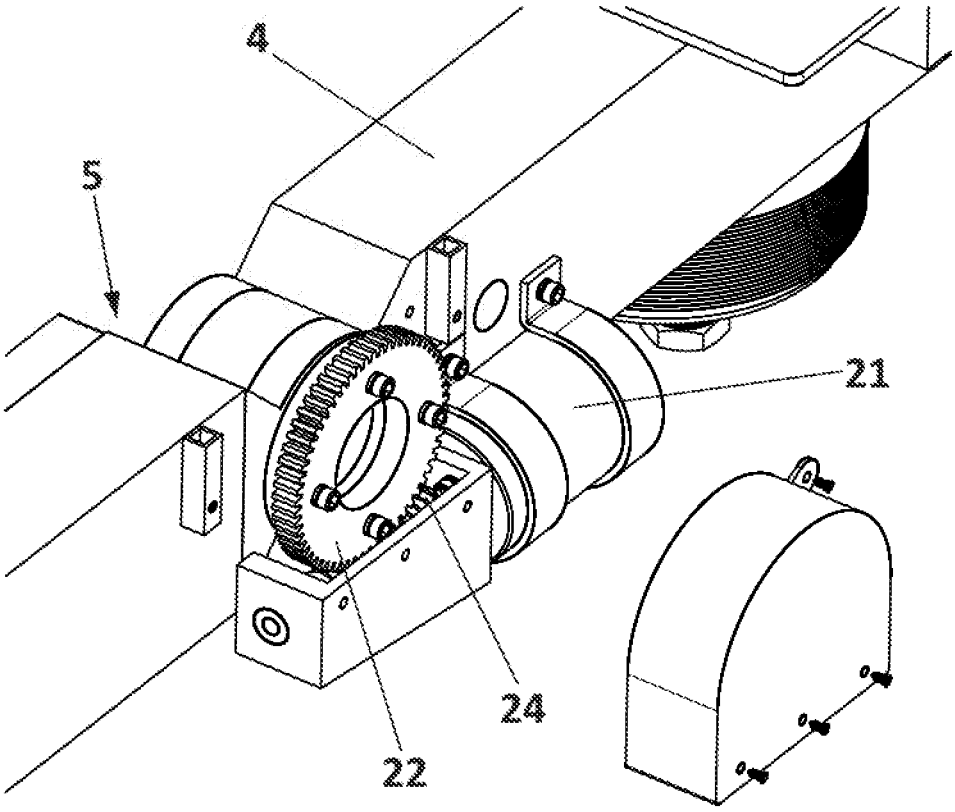
FIG. 7 shows a perspective view of the detail of the articulation between the front support and the fixed support.

As regards the tilting of the front support (5) or of the rear support (8) with regard to the central support (4) represented in FIG. 6 and, therefore, of the front module (9) and of the rear module (11) with respect to the central module (10), the incorporation of respective motors (21) mounted on the central support (4) has been envisaged, as can be observed in FIG. 5 or, in greater detail, in FIG. 7, having a worm screw (24) that attacks a gear (22) solidly connected to each front (5) or rear (8) support, such that the rotary action of each motor (21) determines the respective tilting of the front support (5), as can be observed in detail in FIG. 7, or of the rear support (8) with respect to the central support (4), and solidly and respectively connected to each front (9) or rear (11) module with respect to the central module (10), wherein the stretcher adopts the sitting position of FIG. 2.

As mentioned earlier, the column (3) can be extended or retracted in height, which determines the lifting or lowering of the central module (10) and, therefore, of the front module (9) and of the rear module (11), which implies the lifting or lowering of the patient situated on the stretcher, whether in a lying or sitting position, in accordance with the position of the front module (9) and the rear module (11).

Figure 8:
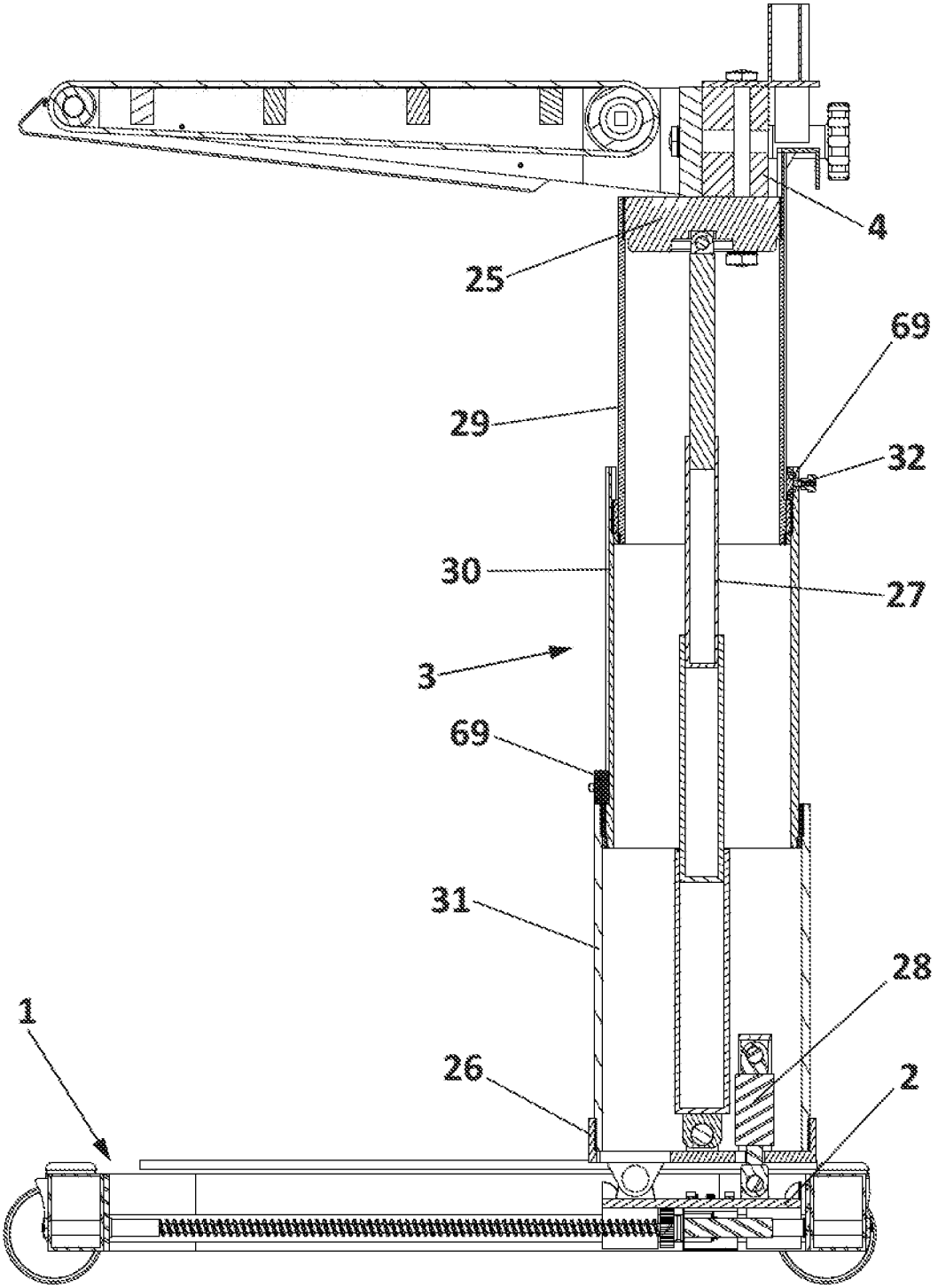
FIG. 8 shows a schematic view wherein the assembly of the fixed support on the column and of the column on the carriage can be observed.

FIG. 8 shows that the column (3) is joined at the top to the central support (4) with the intermediation of a head (25) and at the bottom to a housing (26) tilting with respect to the aforementioned carriage (2) and incorporates a hydraulic cylinder (27) disposed between the housing (26) and the head (25) that causes the vertical movement of the column (3).

Figure 9:
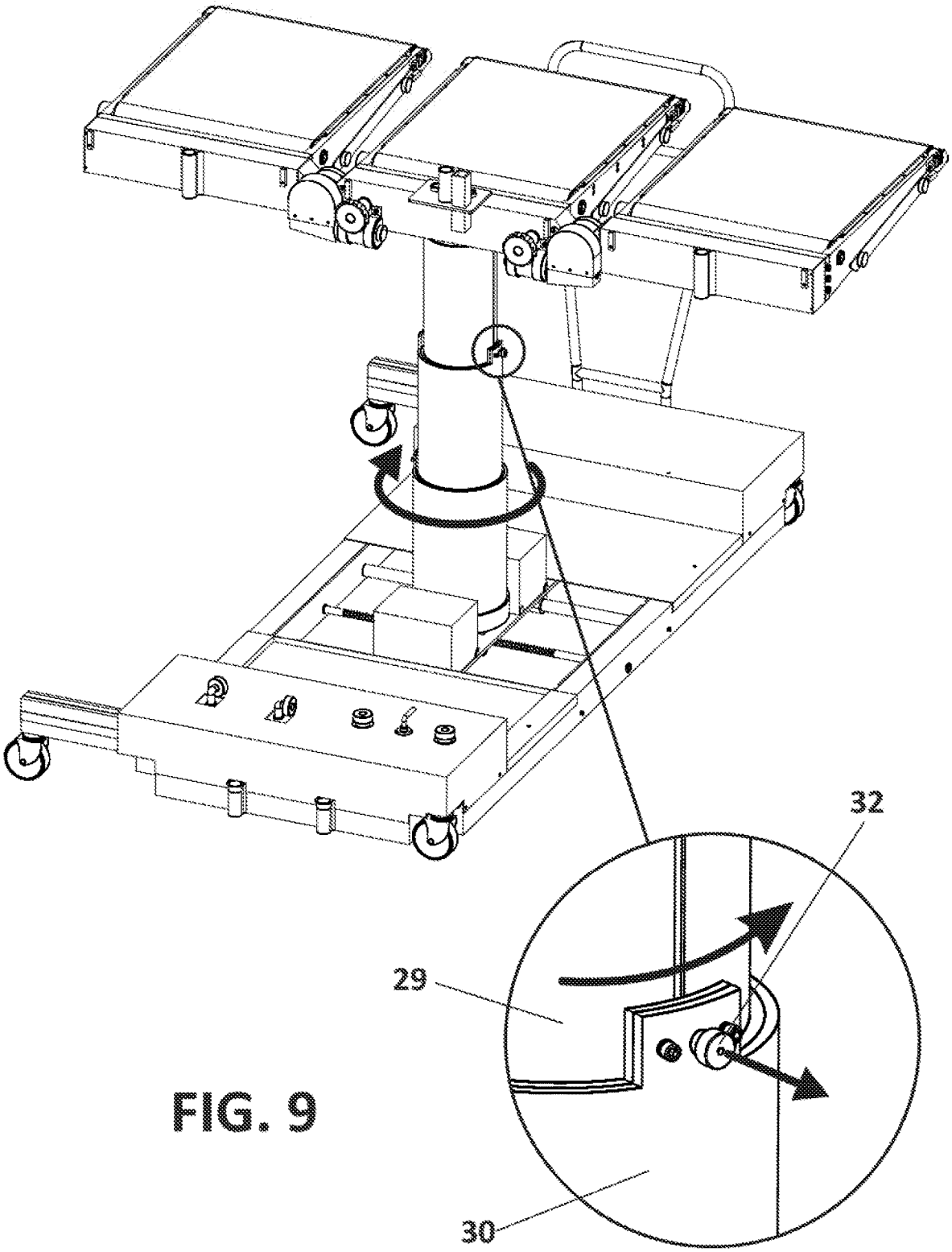
FIG. 9 shows a perspective view of the stretcher in a horizontal position with a transverse orientation and a detail of the blocking means that fix that orientation.

The column (3) is formed by means of various cylinders, including an upper cylinder (29), an intermediate cylinder (30) and a lower cylinder (31), wherein it is envisaged that the upper cylinder (29) and the central support (4) may rotate with respect to the intermediate cylinder (30), causing the solidary rotation of the modules (9, 10, 11) from a longitudinal orientation represented in FIG. 1 to a transverse orientation represented in FIG. 9. In order to fix the stretcher in a longitudinal or transverse orientation, it has been envisaged that the column (3) will incorporate an anchoring element (32) that links the upper cylinder (29) to the intermediate cylinder (30), as can be observed in FIG. 8 or in detail in FIG. 9.

Figure 15:
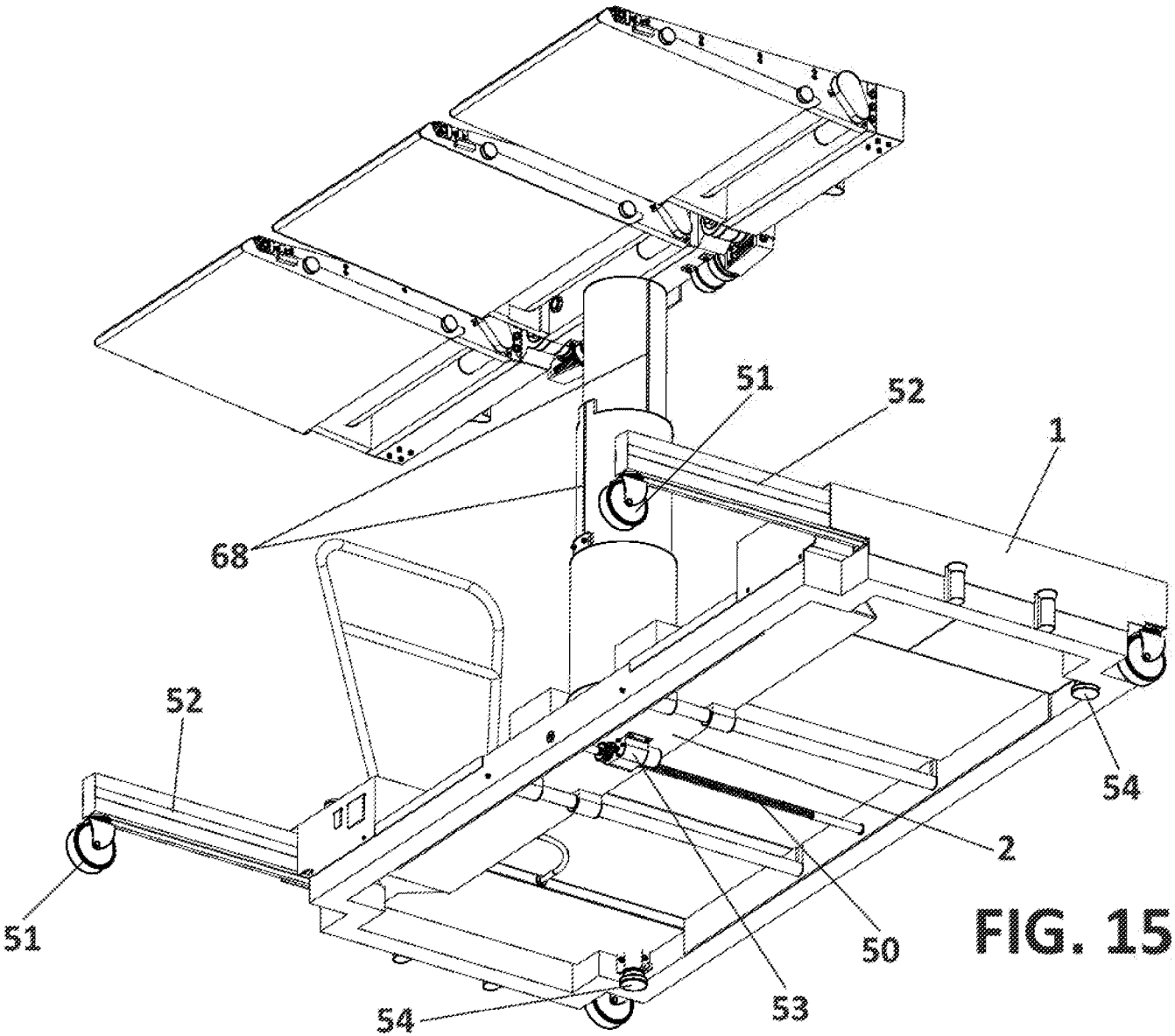
FIG. 15 shows a lower perspective view of the stretcher.

In order to fix the position and the orientation adopted by the modules (9, 10, 11) and, at the same time, facilitate the vertical movement of the cylinders (29, 30, 31), it has been envisaged that the cylinders (29, 30, 31) will move guided therebetween, for which purpose the upper cylinder (29) and the intermediate cylinder (30) will have guides (68), represented in FIG. 15, for example, in correspondence with protuberances (69), shown in FIG. 8, respectively envisaged in the intermediate cylinder (30) and lower cylinder (31), wherealong said guides (68) move.

Likewise, FIG. 8 shows the incorporation of a hydraulic tilt cylinder (28) disposed between the carriage (2) and the housing (26) which, in its movement, determines the tilting of the housing (26) and, therefore, of the column (3) with respect to the carriage (2).

Figure 10:
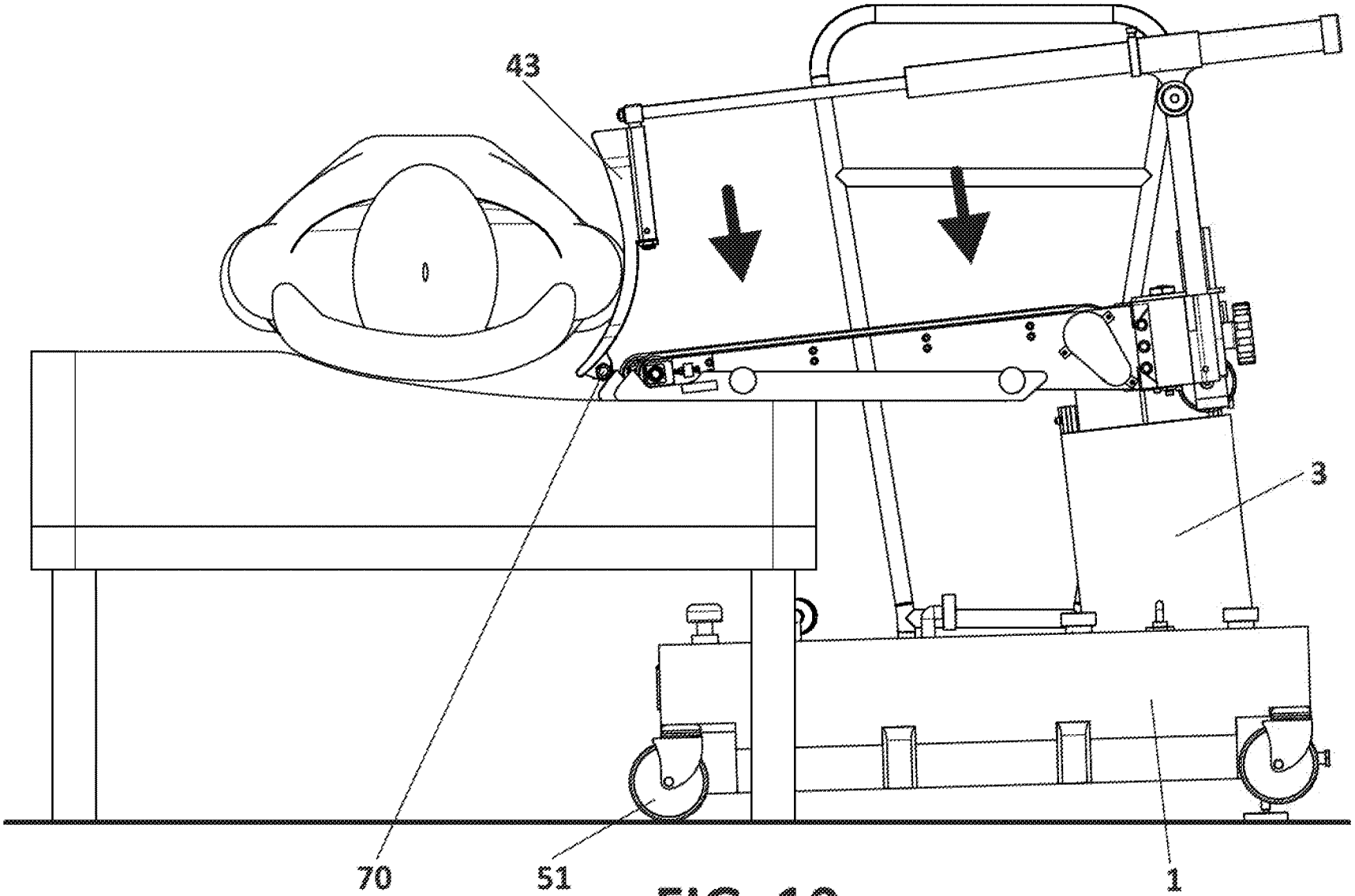
FIG. 10 shows a side view of the initial operation of transferring a patient from a bed to a stretcher.
Figure 11:
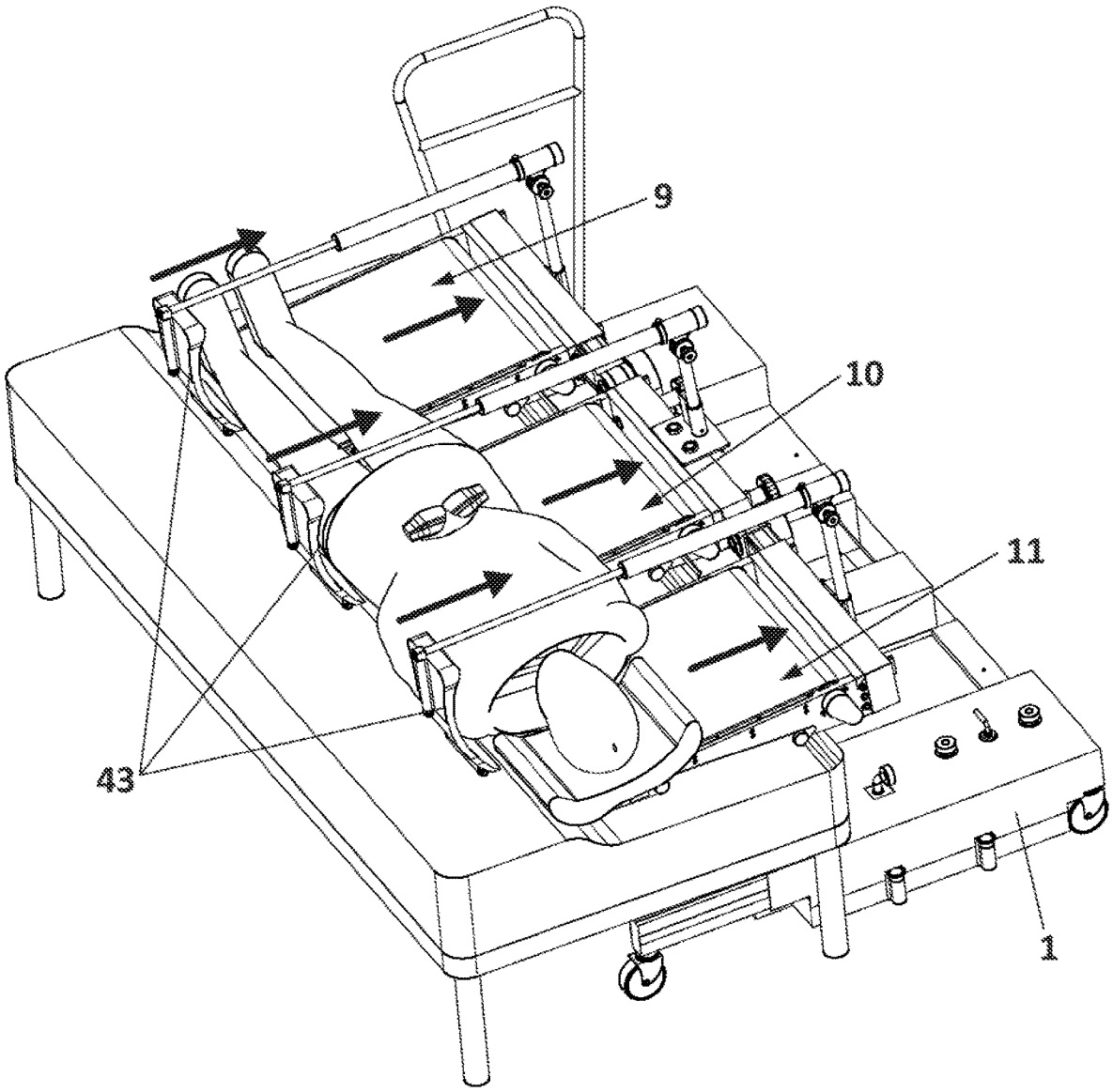
FIG. 11 shows a perspective view of the final operation of transferring a patient from a bed to the stretcher.

The tilting of the column (3) is particularly indicated to facilitate the operation of transferring the patient from the stretcher to a bed, or vice versa, as shown in FIG. 10 or 11.

In these cases, the synchronised action of the modules (9, 10, 11) is of particular importance and, more specifically, of the transport litters (12) that cooperate in the movement of the patient to or from the stretcher, as can be observed in FIGS. 10 and 11. In these figures, the incorporation of fixing and dragging mechanisms (71) which are mounted on the supports (5, 4, 8), destined for jointly cooperating with the transport litters (12) in the transfer of the patient from the bed to the stretcher can also be observed.

Figure 12:
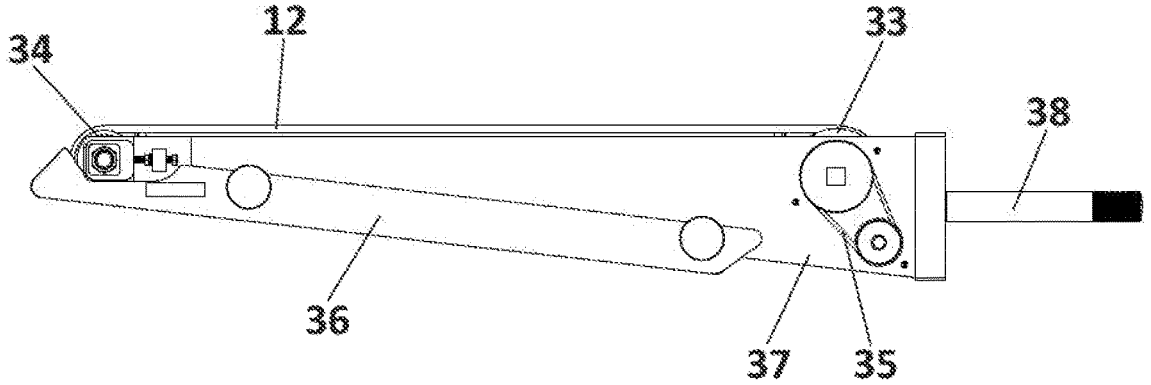
FIG. 12 shows a schematic view wherein a module with the elements that determine the movement of the dragging litter can be determined.

FIG. 12 shows that the modules (9, 10, 11) consist of: a driver roller (33) and a passive roller (34) around which the transport litters (12) move continuously, a motor (not represented, which actuates a transmission mechanism (25) that causes the driver roller (33) to rotate, a lower tray (36) that protects the litter (12) and a frame (37) having fixing means (38) for fixing the modules (9, 10, 11) to the supports (5, 4, 8).

Figure 13:
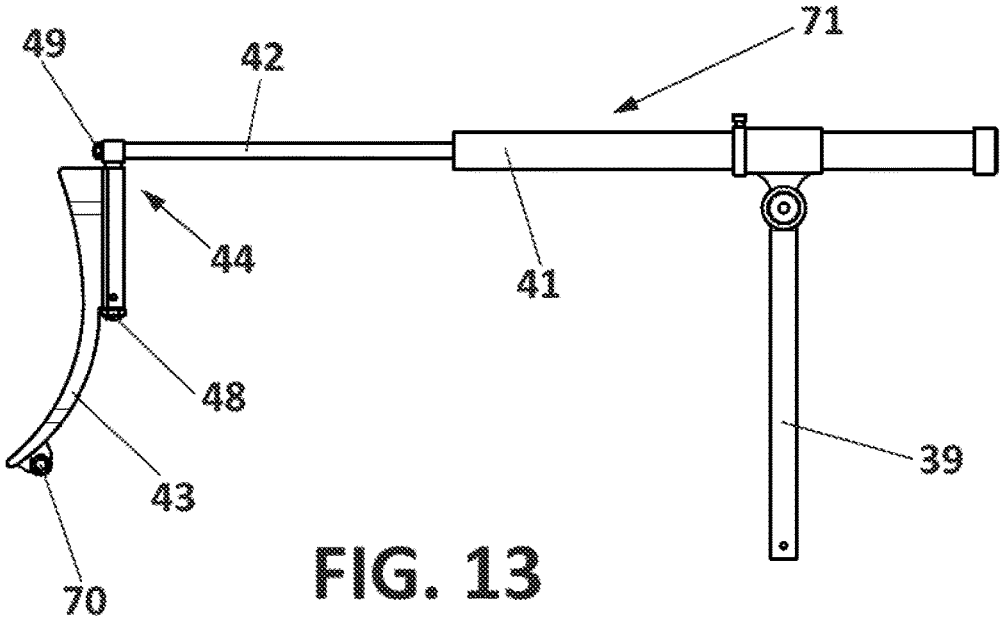
FIG. 13 shows a side view of the holding and dragging mechanism.

As can be observed in FIG. 13, each of the aforementioned fixing and dragging mechanisms (71) used to move the patient comprise a mast (39) that can be coupled to a receptacle (40) envisaged on each support (5, 4, 8), see FIG. 4, and a cylinder (41) linked to the mast (39) having a longitudinally movable extendable rod (42) to the end of which a scoop (43) is associated with the intermediation of an articulation (44). The scoops (43) support the patient in an initial phase during the transfer operation from the bed to the stretcher, as can be observed in FIG. 10, and in a final phase, with opposite orientation, to drag the patient, accommodating him or her on the stretcher, as represented in FIG. 11.

FIG. 10 also shows that the scoop (43) incorporates a roller (70) at the bottom that can rest on the lower tray (36) to facilitate holding the patient during the initial transfer movement from the bed to the stretcher and, subsequently, during the dragging movement of the litters (12), represented in FIG. 11, the roller (70) remains in contact with the litter (12).

It has been envisaged that the articulation (44) will comprise rotation blocking elements that fix the orientation of the scoop (43) in the fixation position of FIG. 10 or in the dragging position of FIG. 11.

Likewise, the articulation (44) comprises tilt blocking elements that fix or release the position of the scoop (43) to facilitate tilting thereof and lift the patient during the movement of the extendable rod (42) in order to then switch from a holding orientation to a dragging orientation and vice versa.

Figure 14:
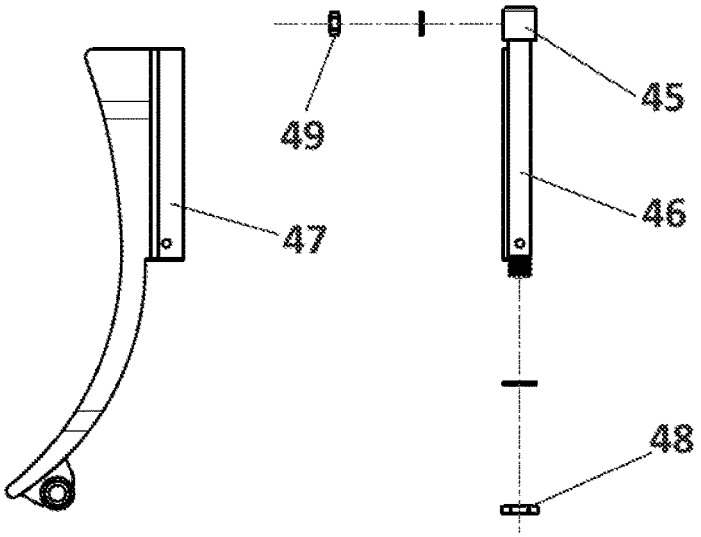
FIG. 14 shows an exploded side view of part of the mechanism of FIG. 13.

The articulation (44) comprises a bolt having a head (45) with a passthrough hole that is penetrated by the end of the extendable rod (42), a cylindrical body (46) that emerges from the lower portion of the head (45), as shown in FIG. 14, and a bushing (47) solidly connected to the back of the scoop (43), in addition to incorporating the aforementioned rotation blocking means that comprise a thread defined in the cylindrical body (46) and a first nut (48) that is threaded onto said thread, fixing the orientation of the scoop (43).

The extendable rod (42) of the cylinder (41) is linked to the head (45) by through the tilt blocking means that comprise a thread defined in the extendable rod (42) and a second nut (49) which, once loosened, allows the upward tilting movement of the scoop (43), bushing (47) and bolt around the extendable rod (42), in order to clear the patient during the subsequent extension of the extendable rod (42).

Next, once the scoop (43) has cleared the patient, the scoop (43) rotates downwards such that its position can be fixed to the extendable rod (42) by means of the second nut (49) so as to subsequently release the first nut (48), which would allow the scoop (43) and bushing (47) to rotate around the cylindrical body (46) until achieving the opposed orientation of the scoop (43) corresponding to the dragging position to continue with the dragging movement of the patient towards the stretcher (see FIG. 11).

Furthermore and in relation to the frame (1), in FIG. 15 it can be observed that the central hollow incorporates a worm scoop (50) which is attacked by a motor (53) that mounts the carriage (2) and allows the transverse movement of the carriage (2) with respect to the frame (1). Likewise, the frame (1) has tubular profiles and wheels (51) mounted on extendable members (52) that can be housed in the aforementioned tubular profiles of the frame (1) or can project therefrom to facilitate the sustainability and stability of the stretcher for certain positions and/or orientation of the column (3) and, therefore, of the modules (9, 10, 11) with respect to the frame (1). The frame (1) similarly incorporates brakes (54), also see FIG. 10, that cooperate in the support and sustainability of the frame (1) in the position in which the wheels (51) are extended.

Figure 16:
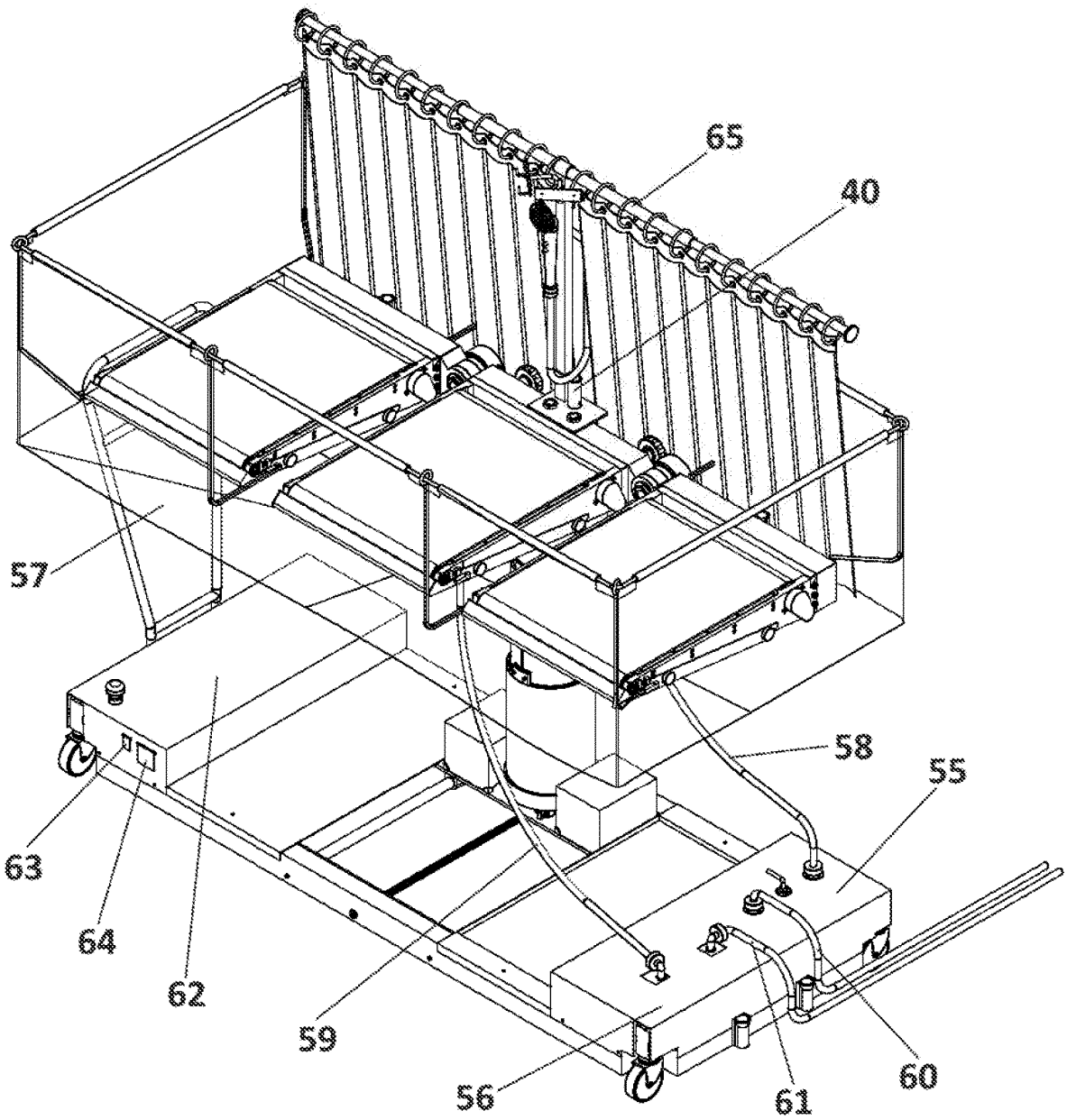
FIG. 16 shows a perspective view of the stretcher with the bathing enclosure assembled.

Complementarily, the possibility of using the stretcher as a place of personal grooming of the patient, as can be observed in FIG. 16, has been envisaged, wherein the stretcher incorporates a bathing enclosure (57) equipped with a drain.

This bathing enclosure can be coupled to the modules (9, 10, 11), which have fixing means envisaged for such purpose; likewise, the frame (1) incorporates a clean water tank (55) and a dirty water tank (56) wherefrom, respectively, a clean water duct (58) emerges towards the stretcher and a dirty water duct (59) emerges and is connected to the drain of the bathing enclosure (57). Likewise, it is envisaged that a clean water feed duct (60) and a dirty water discharge duct (61) will emerge, respectively, from the tanks (55, 56).

Likewise, the stretcher may be considered autonomous by virtue of the incorporation of batteries (62) that are integrated in the frame (1) and which has outgoing connections (63) to couple the ancillary equipment of interest, such as for example a dryer to dry the patient after the bath and which has a charging outlet (64) to facilitate battery recharging (61).

Additionally, it can be observed in this same FIG. 16 or in FIG. 2 that the stretcher incorporates a curtain (65) that can be coupled to the modules (5, 4, 8), specifically to the receptacle (40) of the fixed support (4), to protect the patient's privacy during the bath or while satisfying his or her physiological evacuation needs.

The invention claimed is:

1. A stretcher for people with reduced mobility, which can be transformed from a horizontal position in the manner of a bed to house the patient lying down to a staggered position in the manner of a chair to house the patient sitting down, which comprises:

a frame, a column that extends or retracts in height with respect to the frame, having an upper end and a lower end, a fixed central support mounted on the upper end of the column, a front support tilting with respect to the fixed central support, and a rear support tilting with respect to the fixed central support, front, central and rear modules that can be coupled to the front, fixed central and rear supports, wherein said modules support the patient when in a lying or sitting position, the modules in turn comprising:

transport litters destined for supporting the patient, movable in a transversal direction to the supports in both directions of movement: towards the exterior of the stretcher to remove the patient from the stretcher and towards the interior of the stretcher to accommodate the patient therein, and drive motors that determine the movement of said litters, a carriage that supports the column and which is mounted on the frame with the possibility of transverse movement thereon, a hydraulic tilt cylinder disposed between the carriage and the column that in its movement causes the tilting of the column with respect to the carriage and a plurality of holding and dragging mechanisms mounted on the supports, each of which comprises: a scoop for pushing the patient in the same direction in which the litters move; and a mast that can be coupled to each support and a cylinder fixed to the mast having a longitudinally movable extendable rod to whose end the scoop is associated, with the intermediation of an articulation.

2. The stretcher for people with reduced mobility, according to claim 1, wherein the modules have a driver roller and a passive roller around which the transport litters move continuously, actuated by the drive motors.

3. The stretcher for people with reduced mobility, according to claim 2, wherein each module additionally comprises:

a transmission mechanism associated with the drive motor that rotates the driver roller, a lower tray that protects the litter and a chassis having fixing means for fixing the module to the support.

4. The stretcher for people with reduced mobility, according to claim 1, wherein the articulation comprises rotation blocking elements that fix the orientation of the scoop in the holding or dragging position.

5. The stretcher for people with reduced mobility, according to claim 1, wherein the articulation comprises tilt blocking elements that fix or release the position of the scoop to facilitate tilting thereof and clear the patient during the movement of the extendable rod.

6. The stretcher for people with reduced mobility, according to claim 1, wherein the scoop incorporates a roller at the bottom thereof.

7. The stretcher for people with reduced mobility, according to claim 1, wherein the supports comprise receptacles adapted to receive the masts of the holding and dragging mechanisms.

8. The stretcher for people with reduced mobility, according to claim 7, wherein it additionally comprises a curtain that can be coupled to the receptacles.

9. The stretcher for people with reduced mobility, according to claim 1, wherein the column is fixed at the top to the central support with the intermediation of a head and at the bottom to a housing, and incorporates a hydraulic cylinder disposed between the housing and the head that causes the vertical movement of the column.

10. The stretcher for people with reduced mobility, according to claim 9, wherein the column comprises an upper cylinder, an intermediate cylinder and a lower cylinder, envisaging that the upper cylinder and the central support can rotate with respect to the intermediate cylinder, causing the solidary rotation of the modules from a longitudinal orientation to a transverse orientation.

11. The stretcher for people with reduced mobility, according to claim 10, wherein it additionally comprises an anchoring element that fixes the upper cylinder to the intermediate cylinder, fixing the longitudinal orientation or the transverse orientation.

12. The stretcher for people with reduced mobility, according to claim 1, wherein the central module comprises two small transport litters where between a space is defined destined to facilitate the physiological evacuation of the patient, in addition to comprising a motor and a shaft that links the solidary movement of the two small litters.

13. The stretcher for people with reduced mobility, according to claim 1, wherein it additionally comprises a motor mounted on the carriage and a worm screw associated with the frame, which is attacked by the motor, which allows transverse movement of the carriage and, therefore, of the column and modules with respect to the frame.

14. The stretcher for people with reduced mobility, according to claim 1, wherein the front support is formed by an inner front arm and an extendable front arm which is longitudinally movable with respect to the inner front arm;

the front module is in turn mounted on the extendable front arm, and the rear support is formed by an inner rear arm and an extendable rear arm which is longitudinally movable with respect to the inner rear arm and, the rear module is in turn mounted on the extendable rear arm.

15. The stretcher for people with reduced mobility, according to claim 1, wherein it additionally comprises a bathing enclosure equipped with a drain that can be coupled to the modules.

16. The stretcher for people with reduced mobility, according to claim 15, wherein the frame comprises a clean water tank and a dirty water tank wherefrom, respectively, a clean water duct emerges towards the interior of the bathing enclosure and a dirty water duct emerges connected to the drain of the bathing enclosure.

17. The stretcher for people with reduced mobility, according to claim 1, wherein it additionally comprises batteries integrated in the frame that feed the motors and hydraulic elements, and has outlet connections for connecting ancillary equipment.

18. The stretcher for people with reduced mobility, according to claim 1, wherein the frame has tubular profiles and wheels mounted on extendable members which are housed and can project from the profiles to facilitate sustainability and stability of the stretcher.

19. The stretcher for people with reduced mobility, according to claim 18, wherein the frame incorporates brakes that cooperate in the support and sustainability of the frame in the position in which the wheels are extended.

* * * * *